United States Patent [19]

Goldstein

[11] 4,083,293

[45] Apr. 11, 1978

[54] APPARATUS FOR PLACING LINERS INTO SHIPPING CONTAINER

[75] Inventor: Ralph S. Goldstein, Carol Stream, Ill.

[73] Assignee: Container Corporation of America, Chicago, Ill.

[21] Appl. No.: 767,439

[22] Filed: Feb. 10, 1977

Related U.S. Application Data

[63] Continuation-in-part of Ser. No. 683,096, May 4, 1976, abandoned.

[51] Int. Cl.[2] ..... B31B 7/02

[52] U.S. Cl. ..... 93/36.01; 53/175

[58] Field of Search ..... 93/36.01, 44, 44.1 R, 93/14–20; 53/175

[56] References Cited

U.S. PATENT DOCUMENTS

| | | | |
|---|---|---|---|
| 1,609,491 | 12/1926 | Myers | 93/36.01 |
| 2,162,263 | 6/1939 | Lindholm et al. | 93/36.01 |
| 2,274,345 | 2/1942 | Palmer | 93/36.01 |
| 2,380,913 | 8/1945 | Bennett | 93/36.01 |
| 2,694,965 | 11/1954 | Vergobbi | 93/36.01 |
| 3,380,222 | 4/1968 | Bergmann et al. | 93/36.01 X |

*Primary Examiner*—James F. Coan
*Attorney, Agent, or Firm*—Carpenter & Ostis

[57] ABSTRACT

Apparatus is disclosed for forming and placing a flexible liner into a shipping container with the open end of the liner draped over the sides of the container and the closed end of the liner spread into the bottom corners of the container. The device includes structure supporting a pair of cross heads moving relative to each other, each having a pair of side by side container liner engaging devices for opening and holding the liner in position for insertion into the container. One of the liner engaging devices has a dimension to enter the liner and extend to the closed end thereof, and the other is spaced from the first liner engaging device to enter the liner and extend partway to the closed end thereof, the liner engaging devices being spaced from each other to accommodate therebetween the walls of the shipping container. As the liner engaging devices are moved with respect to the container, the open end of the liner is draped about the container. The collapsible and expandable feature of this device, unlike the rigid form of the prior art, is intended to facilitate liner placement onto the liner engaging devices.

According to one aspect of the invention placement of the liner into a shipping container is achieved by apparatus for moving liner engaging devices by mechanical-fluid means relative to a container for insertion therein of the flexible liner.

According to another aspect, the liner is moved from a roll of flattened liners, severed, opened, and draped about the liner engaging devices, inserted into a shipping container, all of said steps taking place in apparatus performing same automatically.

9 Claims, 14 Drawing Figures

APPARATUS FOR PLACING LINERS INTO SHIPPING CONTAINER

This application is a continuation-in-part of Ralph S. Goldstein application Ser. No. 683,096, filed May 4, 1976 and now abandoned, for apparatus for placing liners in shipping containers.

BACKGROUND OF THE INVENTION

1. Scope of the invention

The structure according to the present invention is primarily directed to the placing of a linear made of flexible material such as polyethylene film or the like into a walled shipping container, the upper open end of the liner being draped about the open end of the container to facilitate loading of product within the liner and the container.

Improved embodiments of the basic invention include structure for moving the liner relative to the container to achieve lining of the container and drape of the liner about the container. Another embodiment includes structure for separating a liner from a roll of same, opening the liner and placing same about liner engaging devices, inserting the liner into a shipping container with the liner draped about the sides thereof, the structure performing said operations automatically.

2. Prior Art

Devices according to the general kind are exemplified in Bennett U.S. Pat. No. 2,380,913 and Hultkrans U.S. Pat. No. 2,375,417. The latter patent discloses a hollow rigid mandrel over which is placed a flexible liner, it being inflated by air to a proper configuration, a shipping container being placed thereover and arranged whereby the outside container is draped with the liner material. The former patent shows a hollow rigid mandrel surrounded by a shorter rigid mandrel over both of which the flexible liner is placed, a shipping container being placed over the flexible liner and having the walls thereof moving between the two rigid mandrel members to effect a drape of the liner about the outer sides of the container.

According to the present invention in all its embodiments, the flexible liner is placed about a pair of paired liner engaging devices, each of such devices having a planar element adapted to enter the liner and to extend to the closed end thereof, the other planar element entering the liner for a lesser distance, and extending along the outer side of the container, the liner engaging devices being mounted upon cross heads movable with respect to each other for ease of placement of the liner for a subsequent erection thereof about the liner engaging devices. When so erected about the liner engaging devices, a shipping container is placed with respect to the liner and the liner engaging devices, the side walls of the container moving between the longer and shorter of such planar members to effect the drape.

SUMMARY OF THE INVENTION

With the foregoing in mind the nature of the invention may be summarized in that placement of a liner onto the liner engaging devices and subsequently into the container is greatly facilitated.

DRAWINGS

Figure 1:
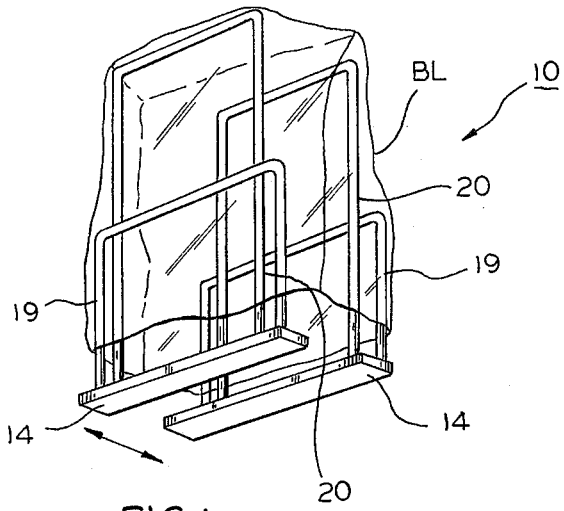
FIG. 1 is a schematic isometric view illustrating the apparatus according to one embodiment of the present invention, and showing a liner in position thereon for insertion into a shipping container.

The apparatus according to the present invention is denoted generally by reference numeral 10 and comprises a base frame 11 supported upon leveling screws 13 in turn resting upon a base 12. A pair of cross heads 14 are mounted for movement relative to each other and to base frame 11, and have secured to the bottom sides thereof spaced guides 15 guided along spaced rails 16. The ends of the guide rails 16 are secured in abutments 17 secured to the base frame 11 by cap screws 18.

Figure 2:
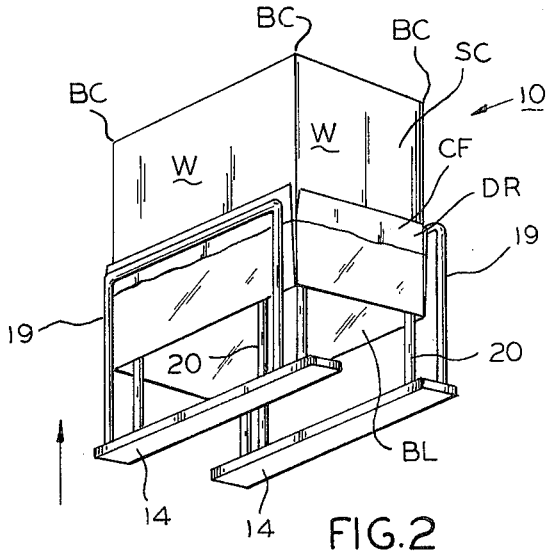
FIG. 2 is a similar view showing the invention apparatus in cooperation with a shipping container whereby the liner is draped about the exterior of the container.

Each of the cross heads 14 is provided with a pair of side by side container liner engaging devices 19 and 20. The cross heads 14 and the paired side by side container liner engaging devices 19 and 20 are arranged selectively to hold a liner BL in position for insertion into a shipping container SC and to provide a drape DR of liner BL about walls W of container SC as seen in FIGS. 1 and 2 particularly.

Figure 3:
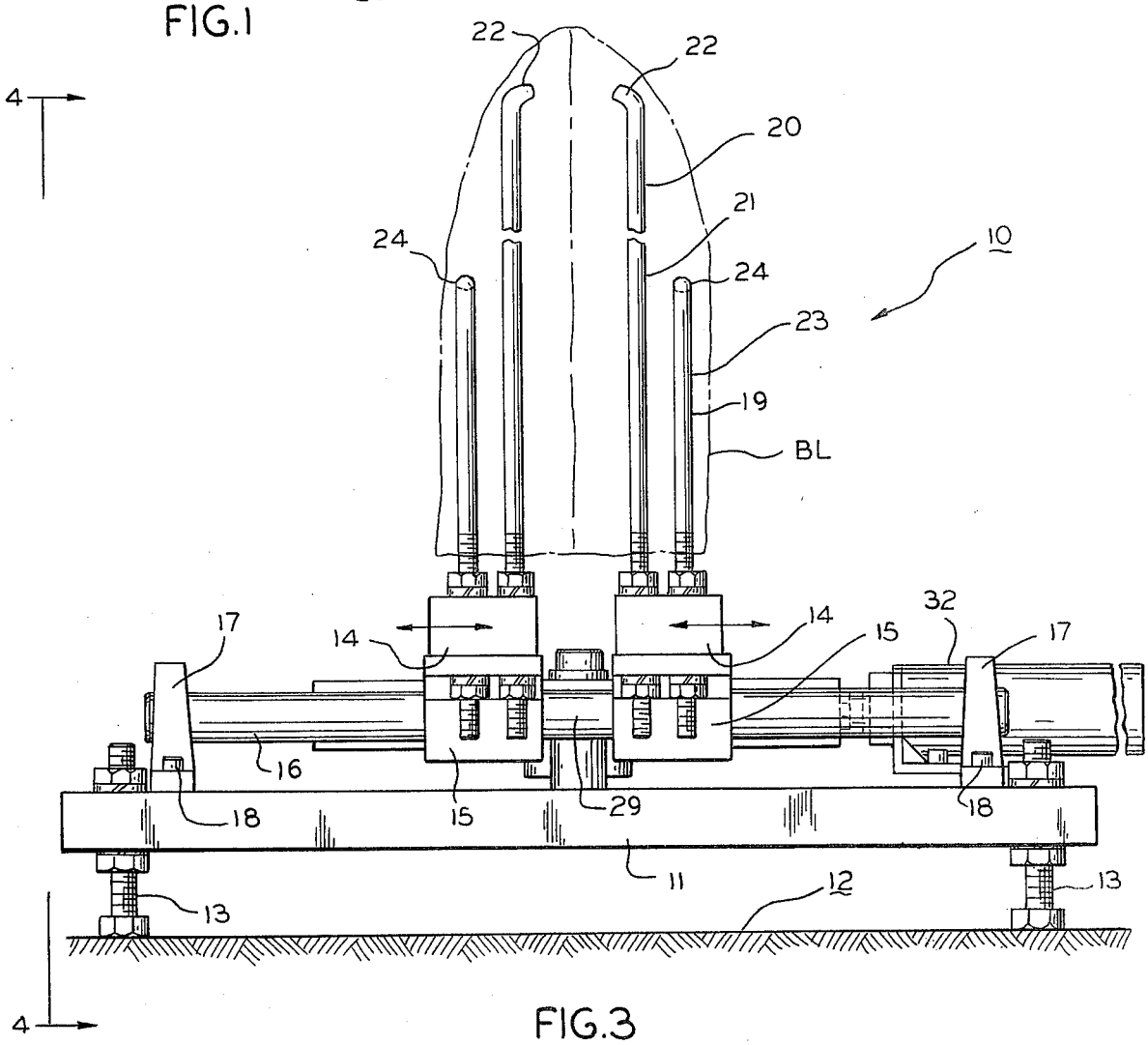
FIG. 3 is a front elevational view.
Figure 4:
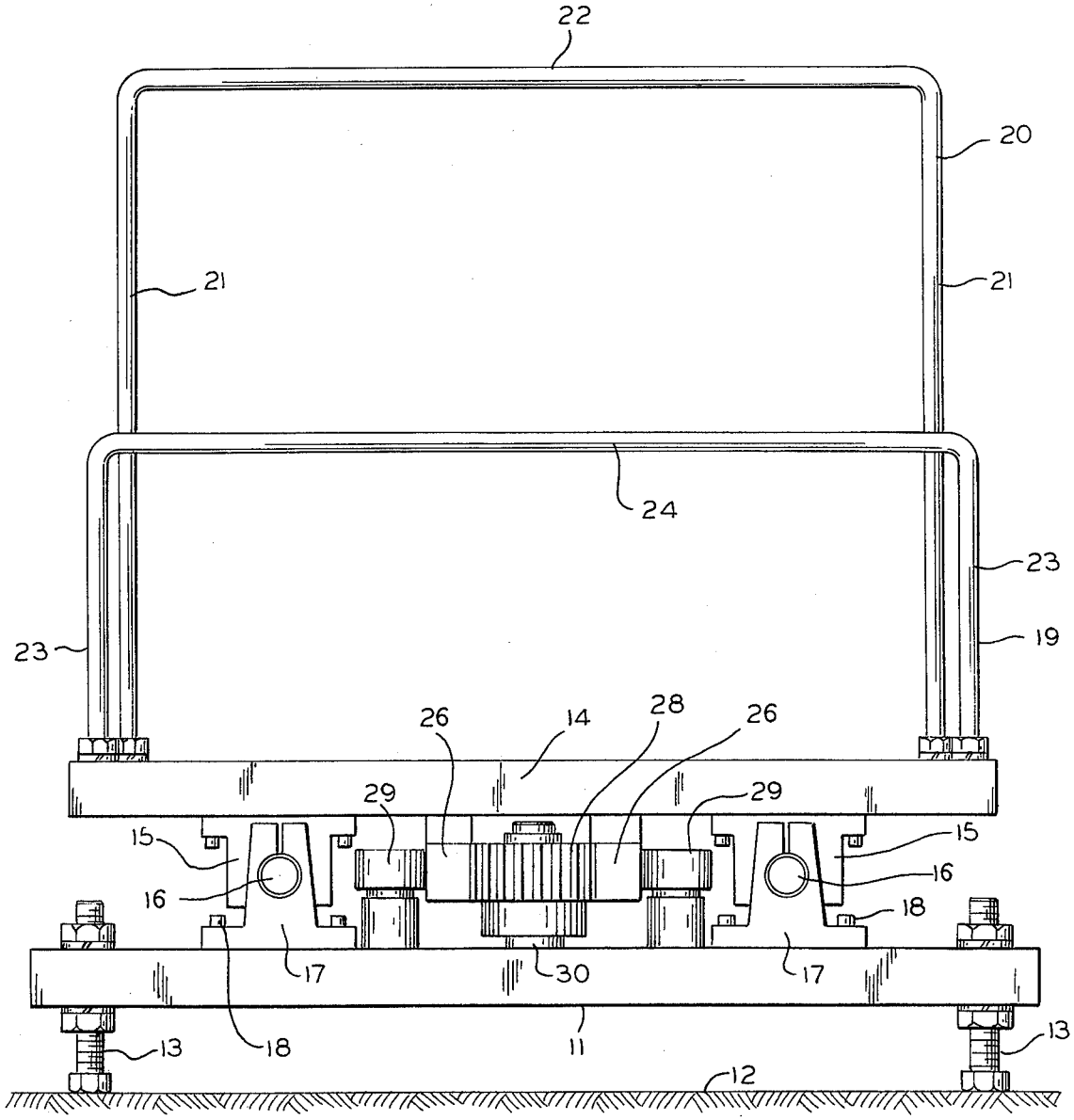
FIG. 4 is an end view looking in the direction of the arrows 4—4 of FIG. 3.
Figure 5:
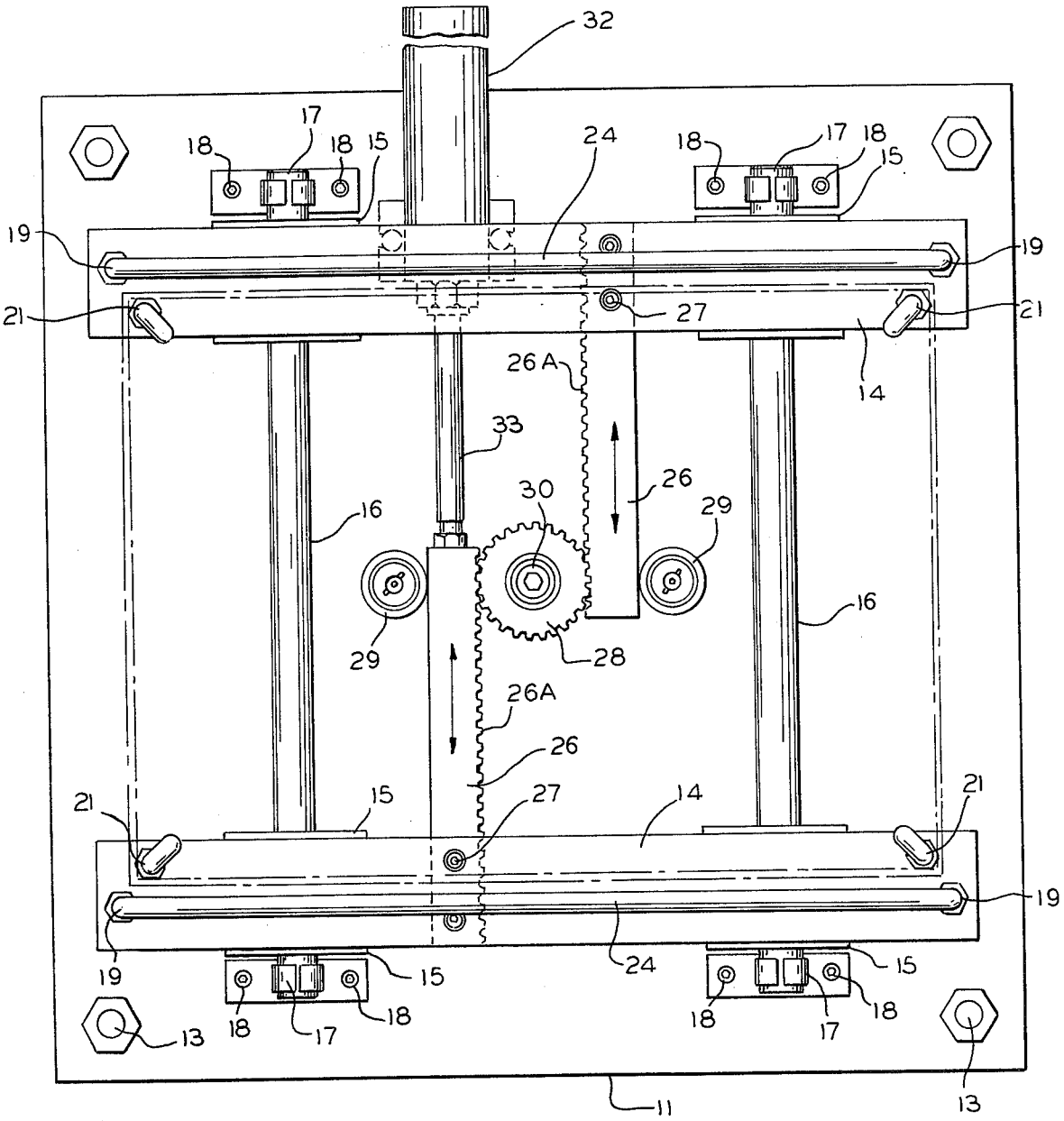
FIG. 5 is a plan view of FIG. 3.

Liner BL has a closed end and an open end whereby it may be placed in position over the paired liner engaging devices 19 and 20 as seen also in FIG. 3. Liner engaging device 20 is of a dimension to enter liner BL and to extend to the closed end thereof. Liner engaging device 20 is generally U-shaped and includes vertical spaced limbs 21 joined at the upper ends thereof by a cross member 22.

The other bag engaging device 19 is also U-shaped and has vertical limbs 23 joined by a cross member 24. However, bag engaging device 19, while it is adapted to enter liner BL, it extends but way to the closed end thereof.

It may be noted that the limbs 23 of liner engaging device 19 are spaced a somewhat greater distance than the limbs 21 of bag liner engaging device 20, and that in each pair of liner engaging devices 20 and 19 the planes thereof are spaced a distance whereby the open ends of a container SC may be placed therebetween. By reason of the additional spacing between the members 23, liner BL is placed thereover, so that walls W of shipping container SC can slide over the limbs 21 and liner BL thereon.

Structure is provided for moving the cross heads 14 relative to each other to cause the bag engaging devices 19 and 20 to shape liner BL for entrance into shipping container SC. To this end each of the cross heads 14 has a rack 26 secured thereto by screws 27, the racks 26 extending toward each other with the rack teeth 26A thereof in confronting relationship. Rack teeth 26A mesh with a pinion 28 mounted on an idler shaft 30. The racks 26 are constrained for proper meshing engagement with pinion 28 by means of guide rollers 29 in contact with the surface of the rack remote from the rack teeth 26A thereof.

Structure is provided for moving one of the racks 26 to cause conjoint movement of the other rack 26 and the cross heads 14 secured thereto. To this end an air cylinder 32 is mounted on the base frame 11 and has piston rod 33 extending therefrom secured to one of the racks 26. The motion of the racks 26 is indicated by the arrows thereon and the operation of the cylinder causes the cross heads 14 to move relative to each other together with the bag liner engaging devices 19 and 20 mounted thereon.

Referring now to FIGS. 1 and 2 when the bag liner BL is placed upon the bag engaging devices 19 and 20, the cross heads 14 move relative to each other to open and shape the bag liner BL. Shipping container SC, which may or may not have closure flaps CF folded against the side walls W thereof, is placed over the spaced bag engaging devices 19 and 20 and bag liner BL therebetween. The shipping container SC and closure flaps CF thereof moved between the bag engaging devices 19 and 20. As the liner engaging devices 20 enter container SC, the closure flaps CF will engage liner BL where it overlaps devices 19 and encounters cross members 24 thereof. At this time and as liner BL enters container SC, the open top thereof is caused to form drape DR over the closure flaps CF, while the closed end of the liner is guided into the bottom corners BC of the container.

Thereafter, the lined container can be removed from engagement with the bag liner engaging devices 19 and 20 and subsequently positioned for loading. At the conclusion of such loading drape DR can be closed on itself in any usual fashion, after which closure flaps CF can be closed. The apparatus may be used in any orientation that is convenient.

Figure 6:
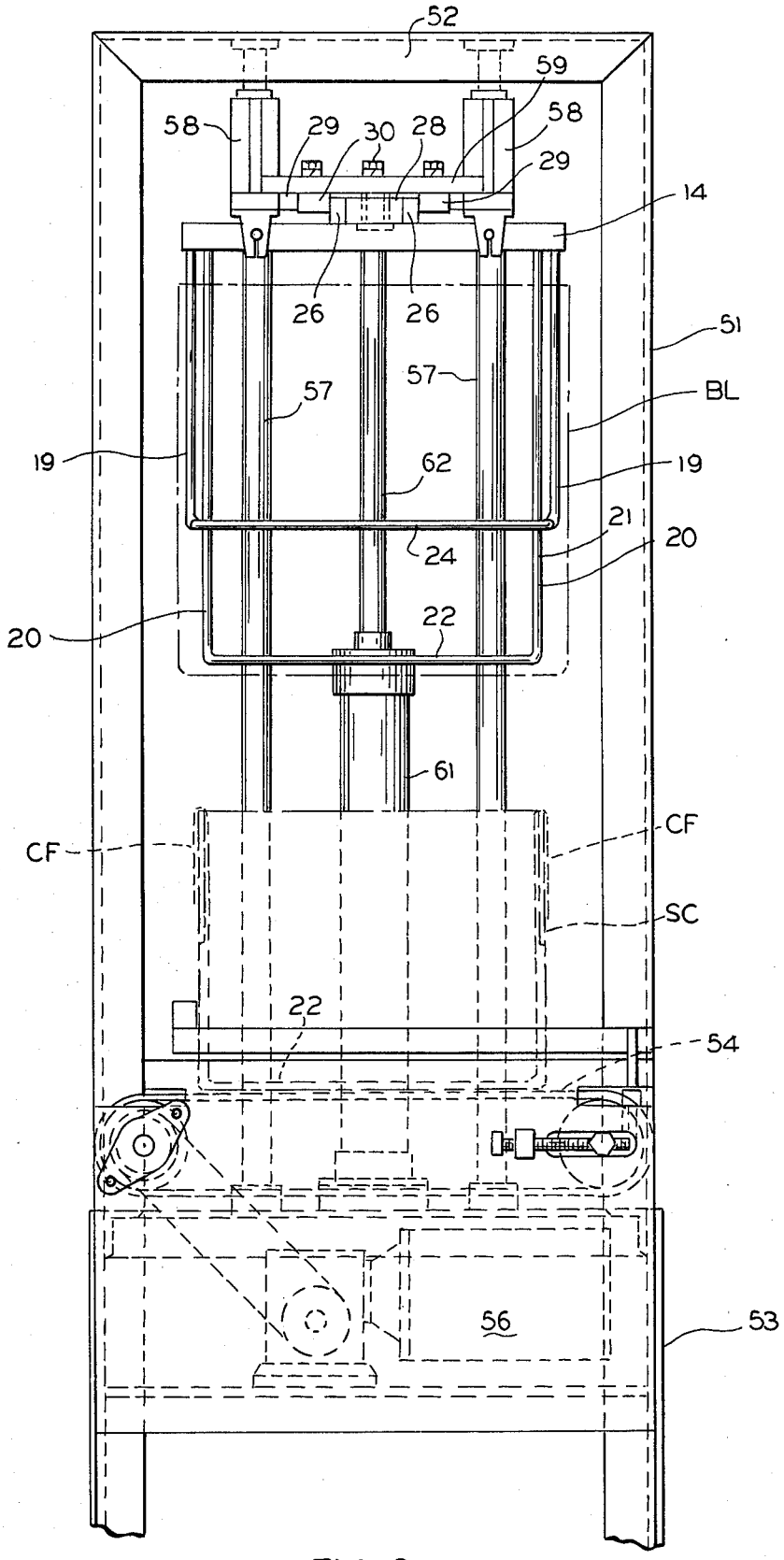
FIG. 6 is an elevation view of another embodiment of the invention structure.
Figure 7:
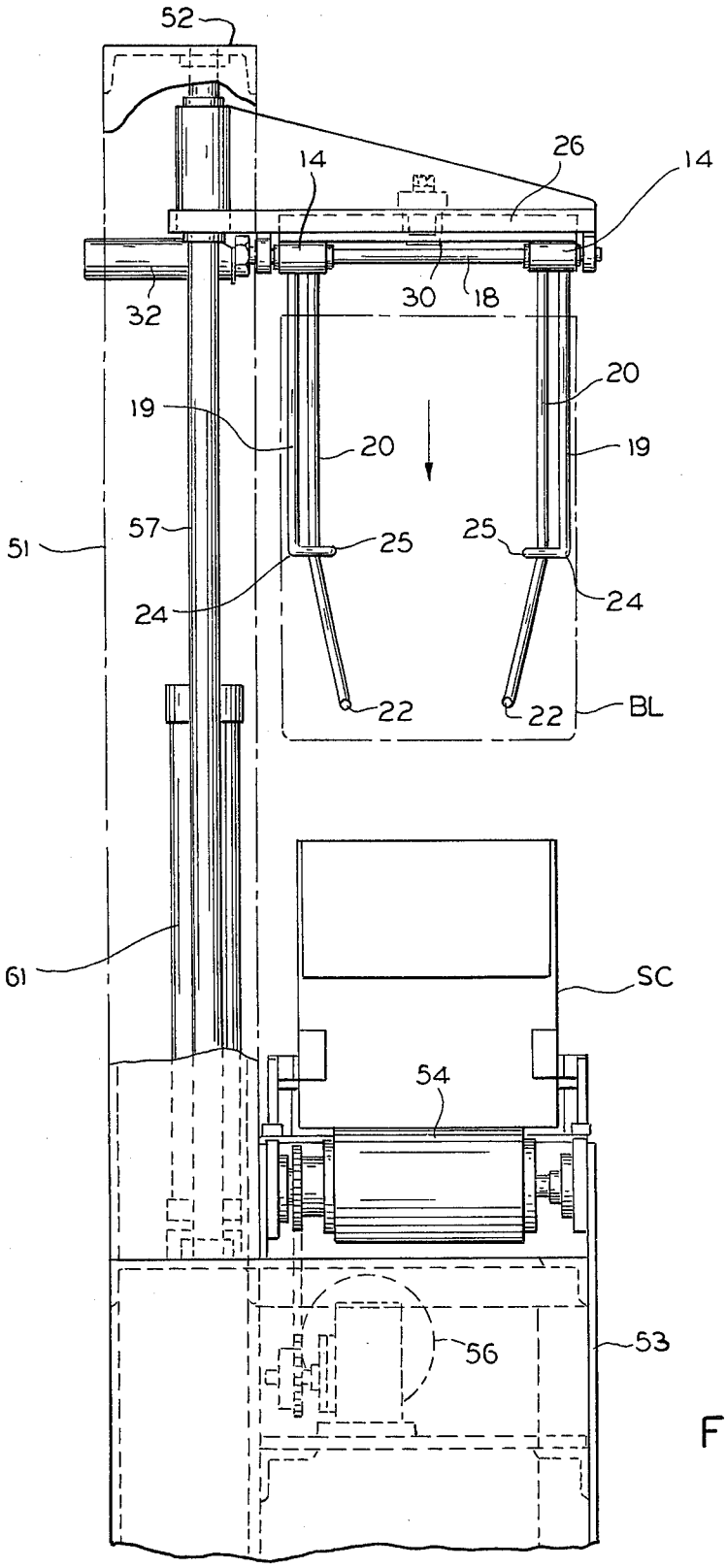
FIG. 7 is a side view thereof.
Figure 8:
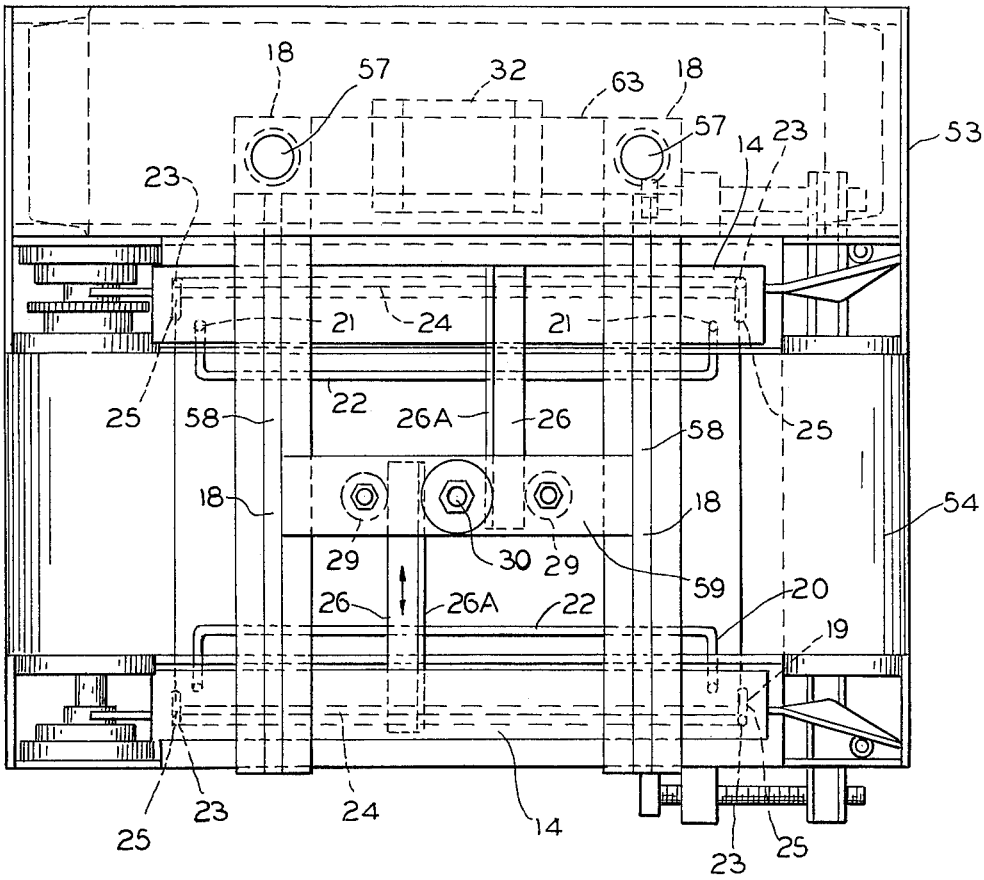
FIG. 8 is a plan view thereof.
Figure 9:
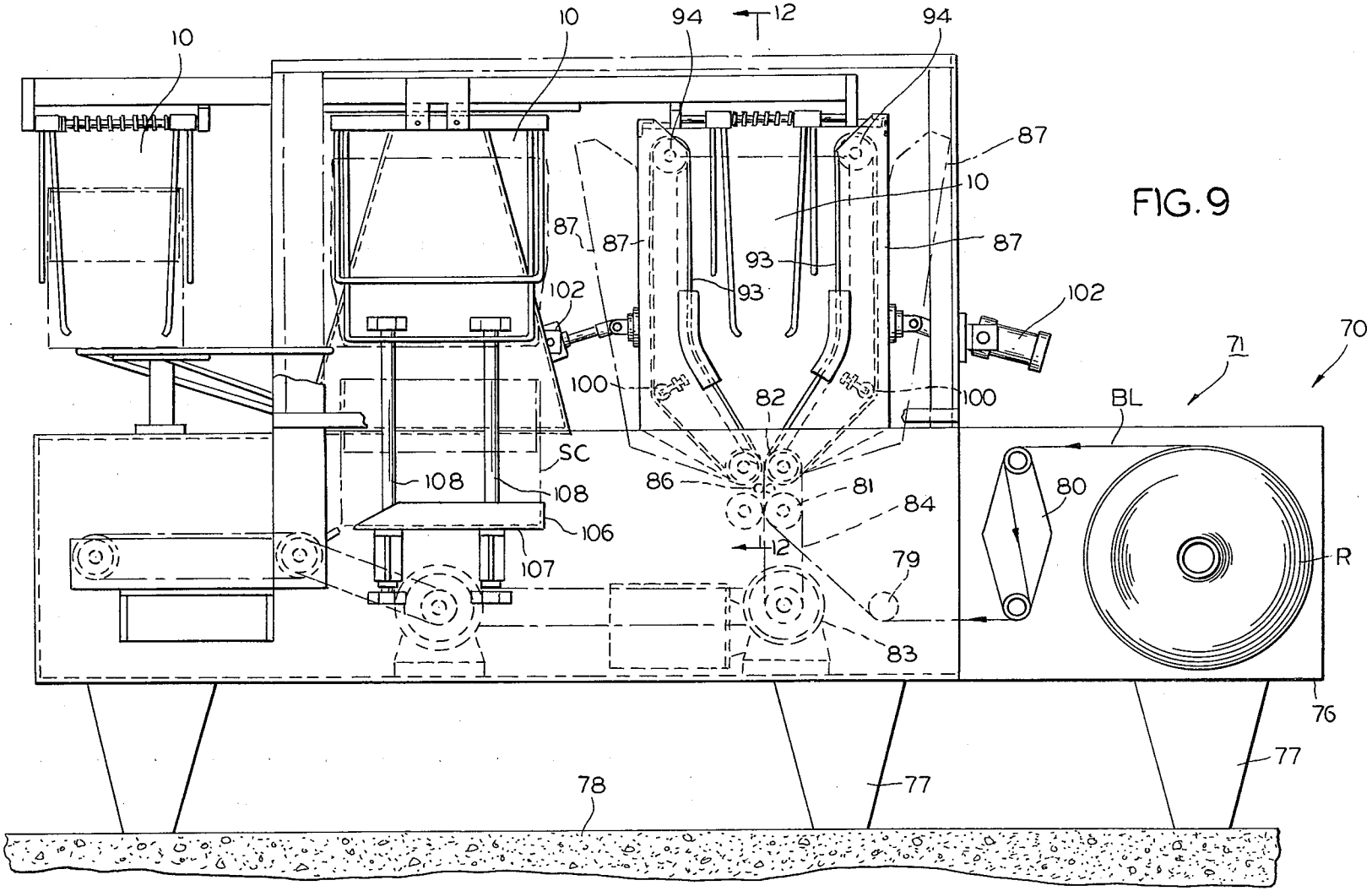
FIG. 9 is an elevation view showing an embodiment wherein the operations are performed automatically.
Figure 10:
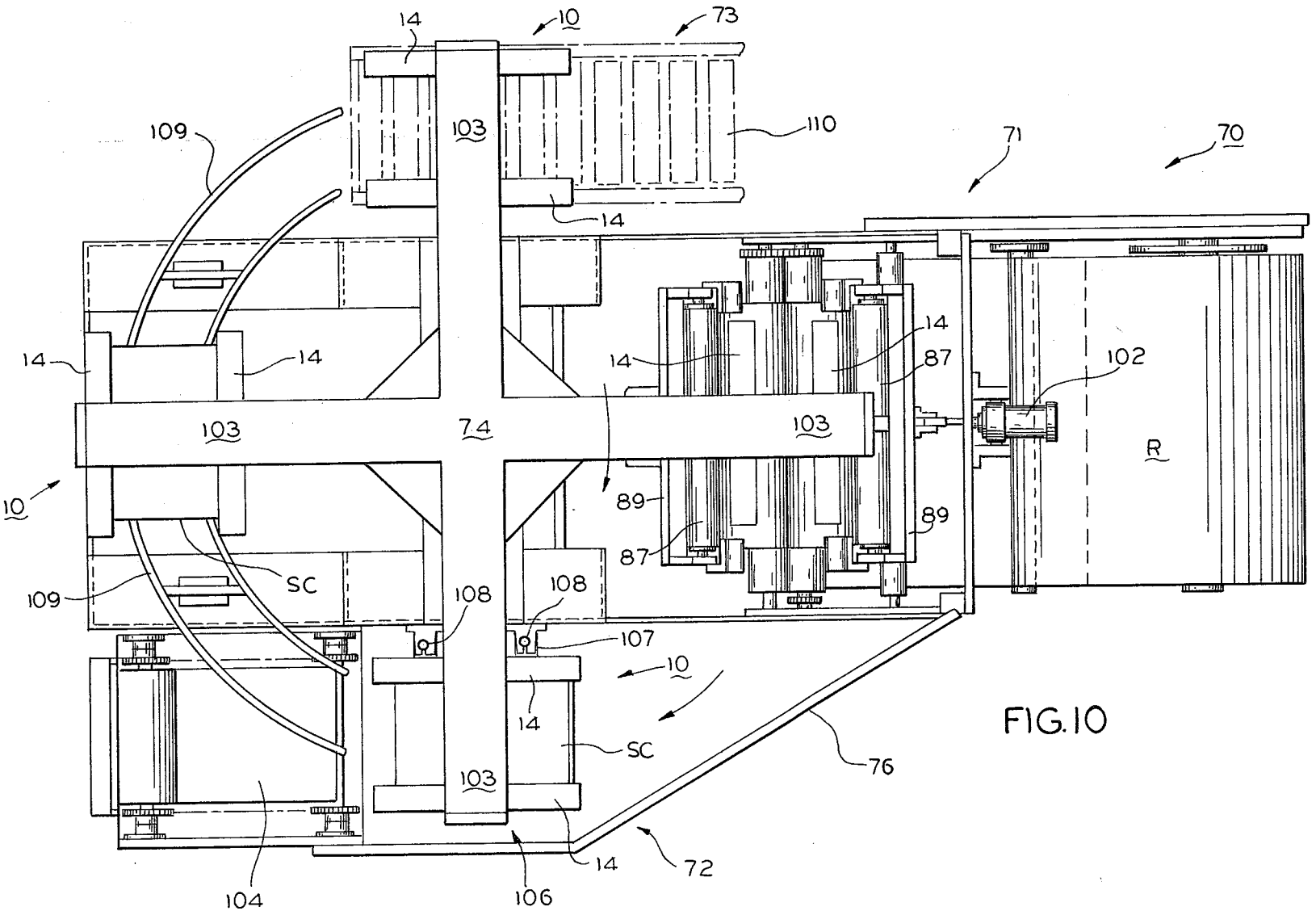
FIG. 10 is a plan view thereof.
Figure 11:
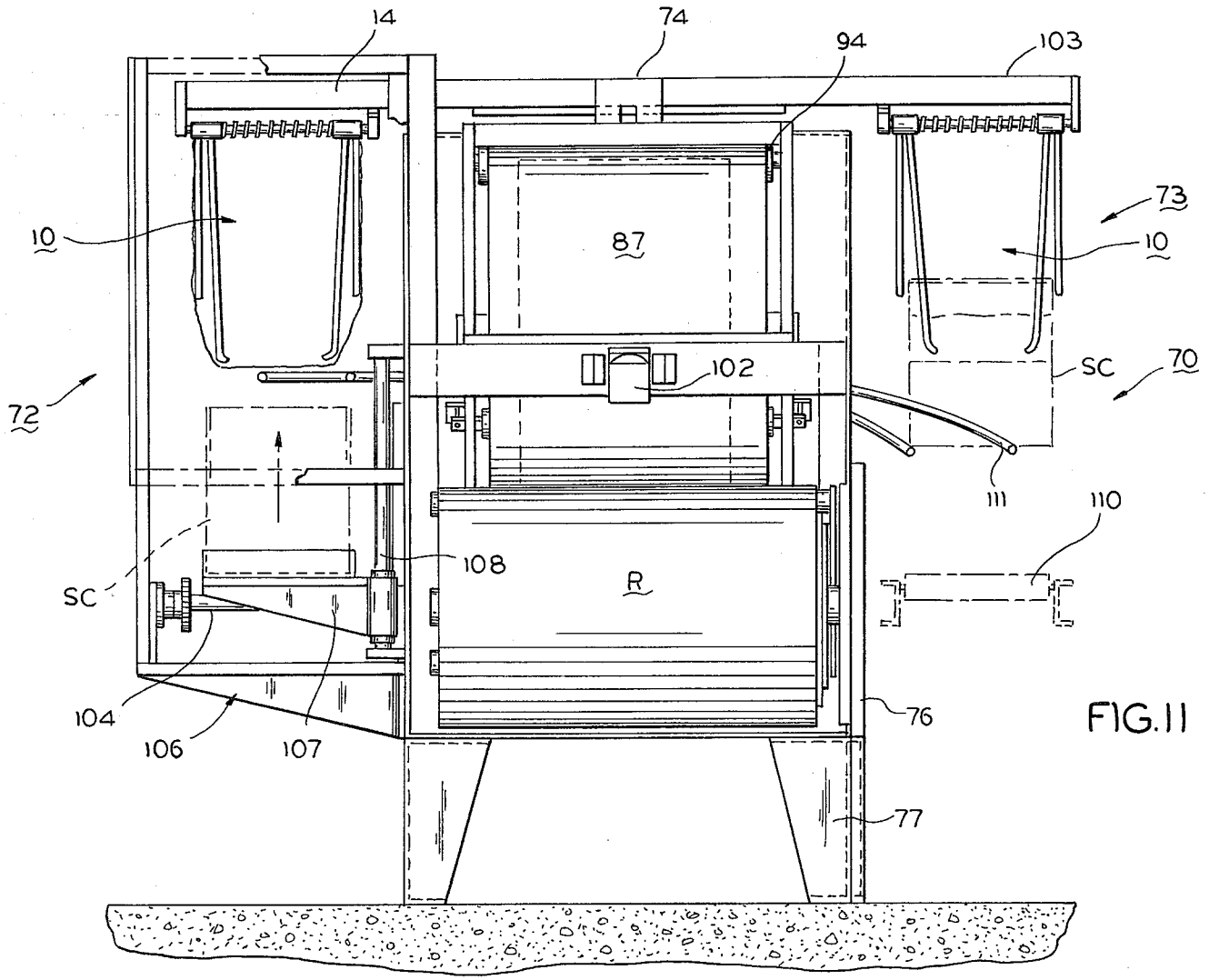
FIG. 11 is a side view thereof.

EMBODIMENT OF FIGS. 6, 7 and 8

Referring now to FIGS. 6 to 8 there is shown an embodiment of the invention wherein structure is provided for moving the invention apparatus with respect to a container for placement of the liner therein and removal of the invention apparatus after such placement.

The structure according to this embodiment of the invention is denoted generally by the reference numeral 50 and parts common also to the embodiment of FIGS. 1 to 5 are denoted by the same reference numerals.

Apparatus 50 comprises a vertical support frame 51 including an upper rail 52, and a base member 53 supporting an endless conveyor 54 driven by a motor and speed reducer 56. Endless conveyor 54 is arranged to move shipping container SC into position for insertion thereinto of a liner BL.

Upper rail 52 and base member 53 are spanned by a pair of vertically extending laterally spaced rails 57 providing a guide for a pair of sliding brackets 58 joined by a mounting plate 59 for a central pinion 28 mounted on an idler shaft 30. Racks 26, one to each side of pinion 28, mesh with pinion 28 and are constrained thereagainst by guide rollers 29 bearing against racks 26 and supported by plate 59.

Each of the racks 26 is connected to crosshead 14 and one of the cross heads 14 is connected to an air cylinder 32, and by reason of the pinion 28 and the racks 26 the two crossheads 14 move with respect to each other upon operation of air cylinder 32.

As with the embodiment of FIGS. 1 to 5, the liner BL is placed about the liner engaging devices 19 and 20, and the cross heads 14 moved as previously described to shape liner BL.

It may be noted in this embodiment that liner engaging device 19 is provided with short limbs 25 extending laterally of the planes defined by the limbs 23 thereof, the short limbs 25 aiding in shaping the drape DR of liner BL when being draped about container SC. Short limbs 25 extend outside of limbs 21 of liner engaging device 20.

Structure is provided for moving liner engaging devices 19 and 20 with respect to shipping container SC supported on conveyor 54, which is now immobile. Devices 19 and 20 now have liner BL erected thereon. Such structure includes an hydraulic or air cylinder 61 secured at its lower end to base 53 and having a piston rod 62 secured at its upper end to an abutment plate 63 extending between brackets 58.

As with the embodiment of FIGS. 1 to 5, liner BL is inserted into container SC and drape DR of liner BL is placed around container SC.

EMBODIMENT OF FIGS. 9 to 14

Referring now to the above figures, there is shown a further embodiment characterized by fully automatic operation and denoted generally by reference numeral 70. It is characterized by structure 71 for supplying flattened two-ply liner stock from a roll R thereof and opening the flattened liner, structure 72 for inserting a liner BL into a shipping container SC, and structure 73 for removing a lined container away from the liner inserting devices, all of said functions being assisted in part by a turret 74.

The automatic apparatus 70 comprises a base frame 76 mounted upon a plurality of feet 77 in turn resting upon a base 78.

Base frame 76 affords a support for roll R of a continuous supply of liners BL, these being of two flattened plies and sealed transversely at regular intervals throughout. The supply of liners BL is led over a tensioning device 80, well known in the art, past an idler roll 79 and into the nip of a pair of breaker rolls 81. From the breaker rolls 81 liner BL is moved into the nip of a pair of feed rolls 82.

Rolls 81 and 82 are driven intermittently by a motor 83 and belt 84, and rolls 82 are driven at a slightly higher speed than rolls 81 in such a fashion that a liner BL is severed at a transverse seal thereof now disposed between rolls 81 and 82.

Any convenient means 86 may be disposed between rolls 81 and 82 for moving any static charges on the film material forming liner BL.

The structure 71 for opening a liner BL includes a pair of opposed plenums 87, each adapted to engage a ply of liner BL, and to separate the plies and advance the opened plies for insertion thereinto of the liner placing apparatus described in detail with respect to the first two embodiments. Such liner placing apparatus will be denoted generally, as before, by reference numeral 10. The liner BL comprised of the separated plies moves intermittently along the plenum 87.

Figure 13:
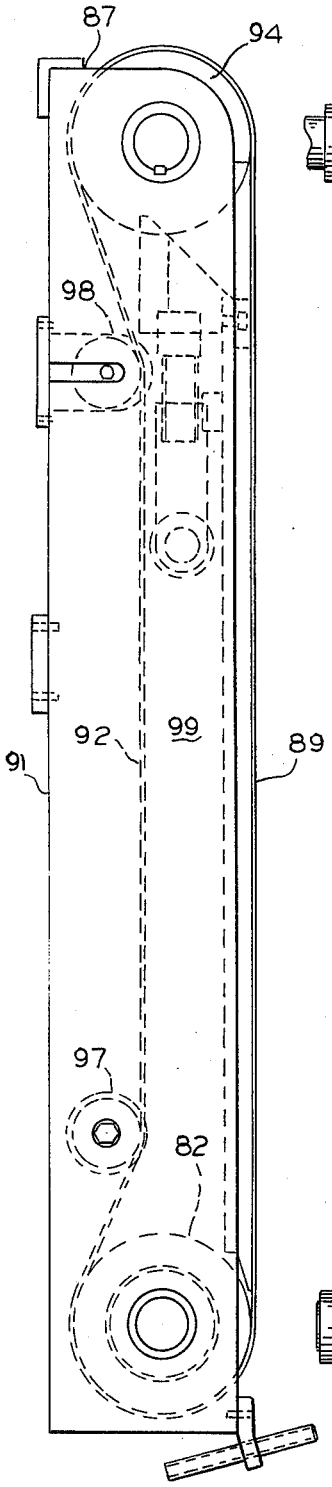
FIG. 13 is a side view thereof.
Figure 12:
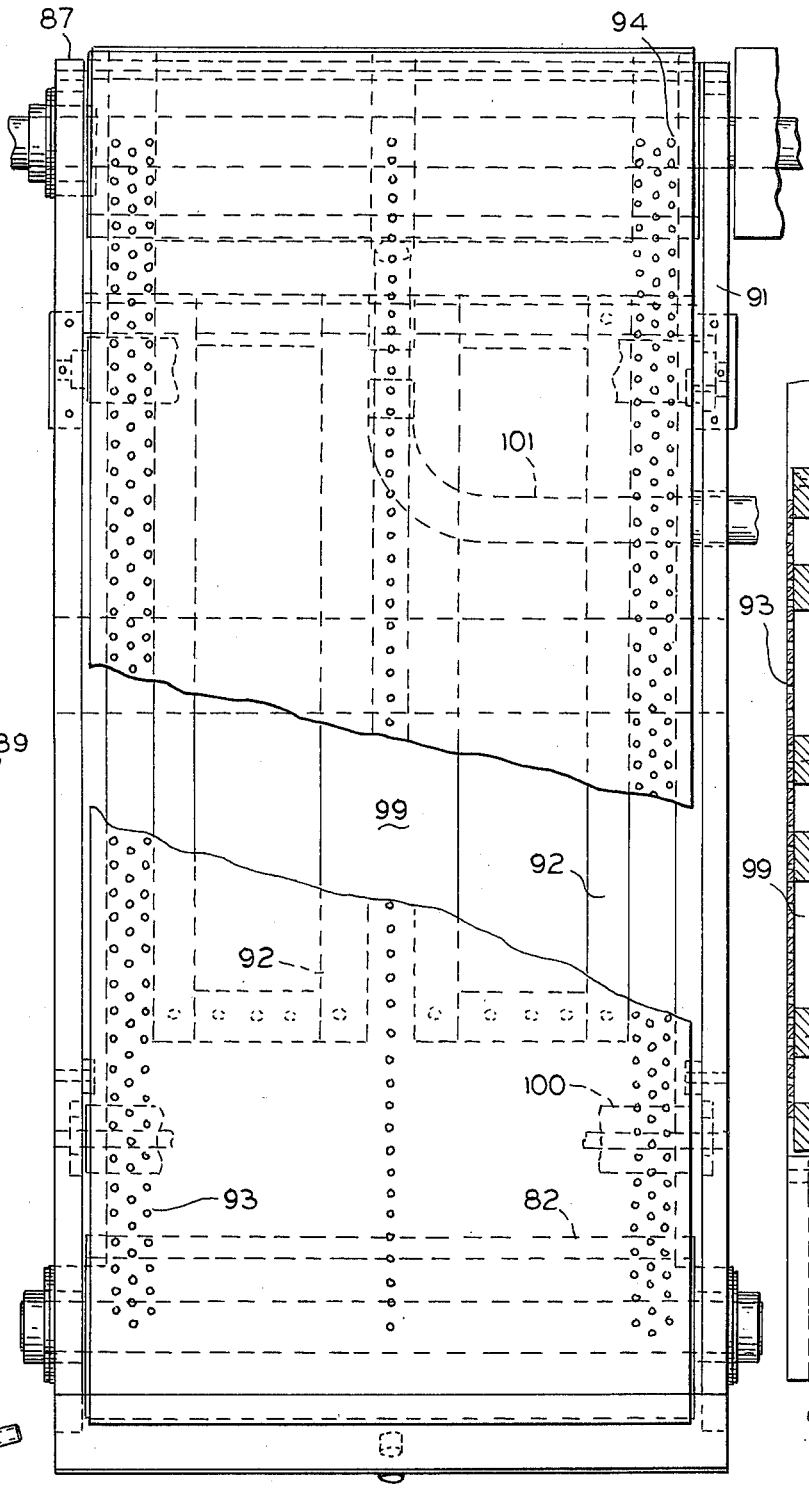
FIG. 12 is an elevation view looking in the direction of the arrows 12—12 of FIG. 9 showing details of structure for opening a liner.
Figure 14:
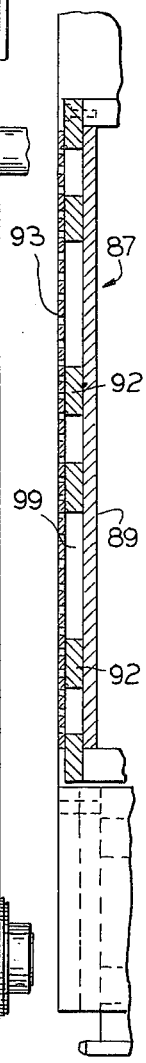
FIG. 14 is a tranverse section taken along the line 14—14 of FIG. 13 looking in the direction of the arrows.

Each of the plenums 87 includes a back frame member 89, see FIGS. 12 to 14 also, having laterally spaces side frames 91 extending therefrom. Back frame member 89 supports stringers 92 for a foraminous belt 93 reeved between an upper roller 94 and lower roller 82 and past hold down idlers 97, 98 and 100. Lower roller 82 is driven from motor 83 as previously explained in an intermittent fashion.

A plenum chamber 99 is defined by back frame 89, side frames 91 and foraminous belt 93, and chamber 99 is subject to subatmospheric pressure by a suction pipe 101.

The two plenums 87 are moved relative to each other by air cylinders 102 connected to each, and when the plenums are in proximate positions, a liner BL is fed by belts 93 along the length of plenum 87, during such movement the plenums moving in divergent directions, so that liner BL can move over the liner placing apparatus 10.

The turret 74 is provided with four equiangularly spaced arms 103, the end of each arm 103 supporting a liner placing apparatus 10. Turret 74 moves in a clockwise direction with a liner BL in place on apparatus 10 thereof to the structure 72 for inserting liner BL into container SC as previously described.

Container SC moves in a direction thereat along a conveyor 104 to a liner inserting station 106 where container SC is raised by an arm 107 guided on vertical rails 108 to receive liner BL. Air operated cylinders, not shown, are provided for such movement. After the return movement of arm 107 lined container SC moves by the sweep of arm 103 and apparatus 10 along a circular track 109 to structure 73 where the lined container SC is separated from apparatus 10.

Structure 73 includes a roller delivery conveyor 110 where a pair of tines 111 engage the lined container SC permitting it to drop onto conveyor 109 for removal.

It should be understood that turret 74 operates in step-by-step fashion, and that structure 71 is similarly operable in such fashion for erection of liner BL and placing same on apparatus 10.

The movement of the cross heads 14 supporting the devices 19 and 20 are operable to receive liner BL when between the plenums 87, and are movable toward each other to receive liner BL, later being moved away from each other for liner erection.

Control circuitry for the described operations forms no part of the invention.

I claim:

1. In an apparatus for placing a container liner having one closed and one open end within a container with the open end of the liner draped over the sides of the container:

(a) means for moving a liner onto inserting means placing said liner into container;

(b) said inserting means having:

(i) a pair of cross heads movable with respect to each other;

(ii) a pair of side by side liner engaging devices mounted on each cross head;

(iii) one of said liner engaging devices being of a dimension to enter said liner;

(iv) the other of said liner engaging devices being spaced from the said one liner engaging devices and being of a dimension to enter said liner and extend at least partway to the closed end thereof;

(v) said liner engaging devices being spaced from each other by a distance to accommodate therebetween a wall of a container so as to place said liner within said container with the open end of said liner draped about said container.

2. In apparatus for placing a container liner having closed and open ends within a shipping container with the open end of liner draped over the sides of the container:

(a) means for supplying flattened container liners sealed transversely thereof at regular intervals to define a continuous supply;

(b) means for severing and opening discrete liners;

(c) means for moving an opened liner onto liner inserting means for a shipping container;

(d) said liner inserting means having:

(i) a pair of cross heads movable with respect to each other, (ii) a pair of side by side liner engaging devices mounted on each cross head, (iii) said cross heads and said side by side liner engaging devices being arranged selectively to open and hold said liner in position and to release same, (iv) one of said liner engaging devices being of a dimension to enter said liner and to extend to the closed end thereof, (v) the other of said liner engaging devices being spaced from the said one liner engaging devices and being of a dimension to enter said liner and extend partway to the closed end thereof, (vi) said liner engaging devices being spaced from each other by a distance to accommodate therebetween a wall of a shipping container so as to place said liner within said container with the open end of said liner draped about said container.

3. Apparatus according to claim 2 wherein liner inserting means are mounted on a turret and are movable between positions receiving a liner, placing a liner into a container, and removing a lined container from said liner inserting means.

4. Apparatus according to claim 3 wherein separate liner inserting means are spaced about said turret.

5. Apparatus according to claim 2 wherein conveyor means are provided for moving a shipping container into position for insertion therein of a liner, and for removing a lined container from said liner inserting means.

6. Apparatus according to claim 2 wherein the means opening a discrete liner includes liner engaging means are separable to a position for insertion into the opened liner of said liner inserting means.

7. Apparatus according to claim 3 wherein said turret operates in step-by-step fashion.

8. Apparatus according to claim 2 wherein the means (b) and (c) includes a pair of plenums each having a foraminous endless belt moving therealong and subject to sub-atmospheric pressure to open said liner.

9. Apparatus according to claim 8 wherein said foraminous belt moves said liner into position onto said liner inserting means.

* * * * *